US011758999B1

(12) United States Patent
Hetzel

(10) Patent No.: US 11,758,999 B1
(45) Date of Patent: Sep. 19, 2023

(54) PACK

(71) Applicant: Amer Sports Canada Inc., North Vancouver (CA)

(72) Inventor: Ryan Hetzel, Squamish (CA)

(73) Assignee: Amer Sports Canada Inc., North Vancouver (CA)

( * ) Notice: Subject to any disclaimer, the term of this patent is extended or adjusted under 35 U.S.C. 154(b) by 45 days.

(21) Appl. No.: 17/688,090

(22) Filed: Mar. 7, 2022

(51) Int. Cl.
*A45F 3/04* (2006.01)
*A45F 3/12* (2006.01)

(52) U.S. Cl.
CPC ..... *A45F 3/047* (2013.01); *A45F 3/12* (2013.01)

(58) Field of Classification Search
CPC .. A45F 3/04; A45F 3/042; A45F 3/047; A45F 3/06
See application file for complete search history.

(56) References Cited

U.S. PATENT DOCUMENTS 6,164,509 A * 12/2000 Gausling ..... A45F 3/04 224/259
6,837,409 B2 * 1/2005 Lemanski, II ..... A45F 3/04 224/641
8,844,781 B2 9/2014 Rose et al.
8,876,568 B2 11/2014 Blenkarn et al.
8,893,940 B2 * 11/2014 Green ..... A45F 3/08 224/604
9,272,187 B2 3/2016 Blenkarn et al.
9,427,625 B2 8/2016 Rose et al.
9,731,801 B2 8/2017 Blenkarn et al.
9,770,626 B2 9/2017 Rose et al.
10,004,320 B2 6/2018 Reid et al.
10,165,846 B1 * 1/2019 Gordon ..... A45C 7/0077
10,556,137 B2 * 2/2020 Rose ..... A45F 4/02
2002/0162871 A1 * 11/2002 Vigny ..... A45F 3/04 224/628
2013/0185853 A1 * 7/2013 Ricart ..... A41D 13/0531 224/259
2018/0360198 A1 * 12/2018 Gordon ..... A45C 7/0077
(Continued)

FOREIGN PATENT DOCUMENTS

CA 2435630 C * 5/2008 ..... A45F 3/04
CA 3037441 A1 * 12/2018 ..... A45C 7/0077
EP 2545803 B1 * 8/2014 ..... A45F 3/047
(Continued)

*Primary Examiner* — Justin M Larson
(74) *Attorney, Agent, or Firm* — Terence P. O'Brien; Todd A. Rathe

(57) ABSTRACT

A pack may include a main compartment to extend along a back of a person wearing the pack, wherein the main compartment has a front side to extend proximate the back of the person and a rear side to extend distant the back of the person. The pack may include left and right compression panels and a main compartment cinching system. The left and right compression panels extend along the left and right sides of the person, respectively, to the rear side of the main compartment. The compartment cinching system has left and right cinch cords and left and right cinch cord retainers located along left and right sides of the person, respectively, when the pack is worn. The left or right cinch cords are pullable to concurrently compress the main compartment and cinch the left and right compression panels about a torso of the person.

20 Claims, 9 Drawing Sheets

(56) References Cited

U.S. PATENT DOCUMENTS

2020/0214429 A1* 7/2020 Goulet ..... A45F 3/04

FOREIGN PATENT DOCUMENTS

| | | | | | |
|---|---|---|---|---|---|
| EP | 2620064 | B1 * | 9/2015 | ..... | A41D 13/05 |
| EP | 2965645 | A2 * | 1/2016 | ..... | A41D 13/05 |
| GB | 2529725 | A * | 3/2016 | ..... | A45F 3/14 |
| JP | 7232917 | B2 * | 3/2023 | ..... | A45F 3/04 |
| WO | WO-02060297 | A1 * | 8/2002 | ..... | A45F 3/04 |

* cited by examiner

FIG. 14
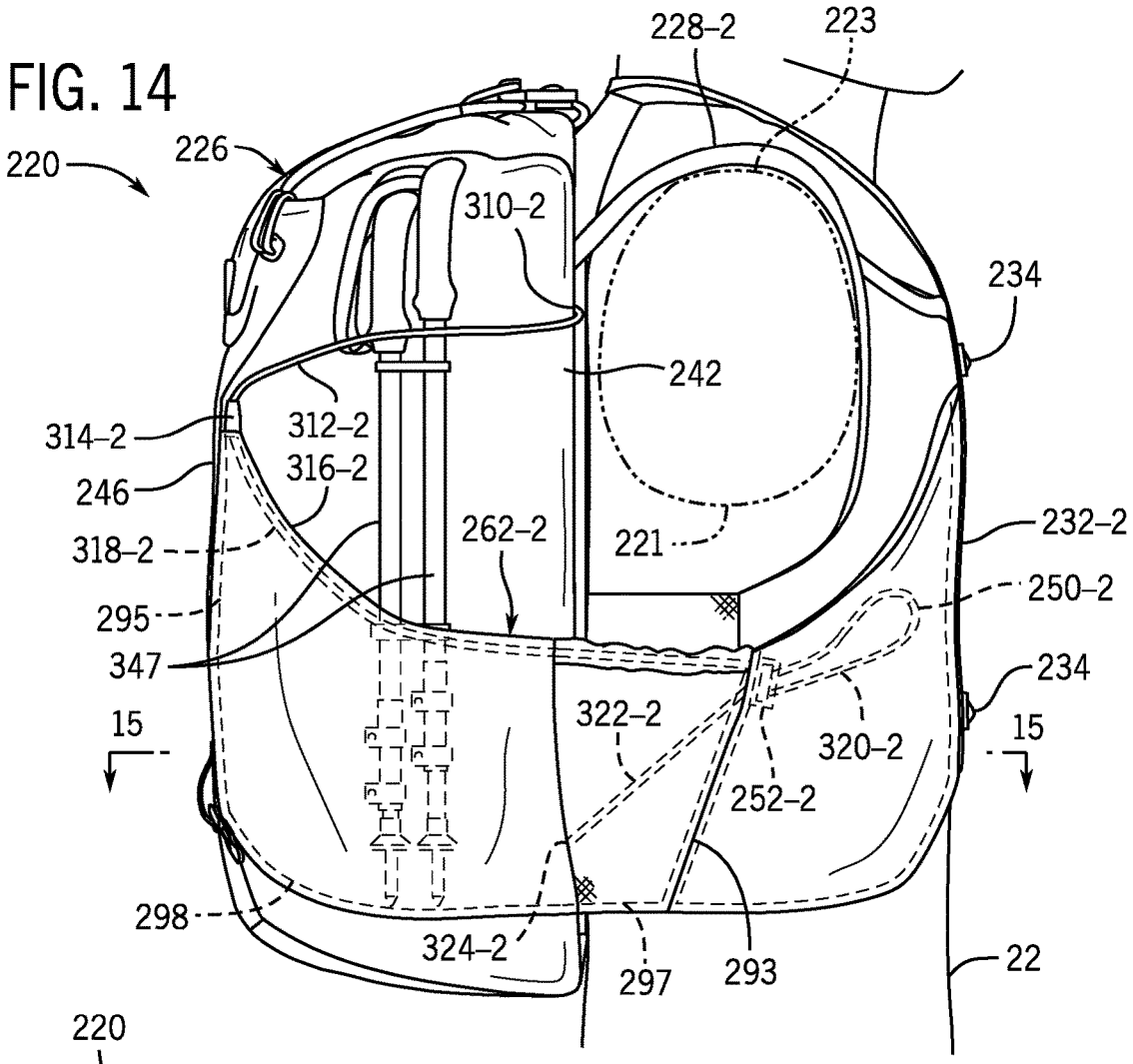
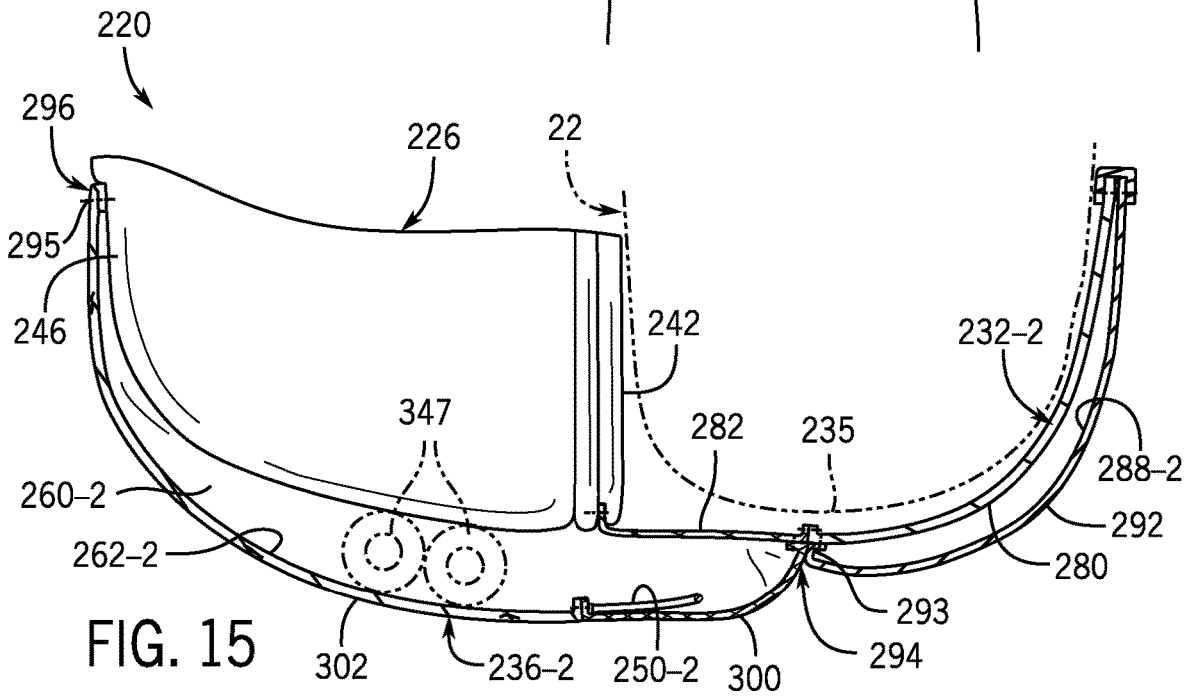
FIG. 15

PACK

BACKGROUND

Packs, sometimes referred to as backpacks, may be worn by a person to carry various articles or loads. Packs worn while running or hiking, sometimes referred to as running packs or endurance vests, are frequently used to carry articles such as keys, fluids, nutrition, electronics, additional apparel, and the like for possible use during a trail run or hike.

BRIEF DESCRIPTION OF THE DRAWINGS

FIG. 14 is a right side view of the pack of FIG. 1 being worn.

FIG. 15 is a sectional view of the pack of FIG. 14 taken along line 15-15.

Figure 1:
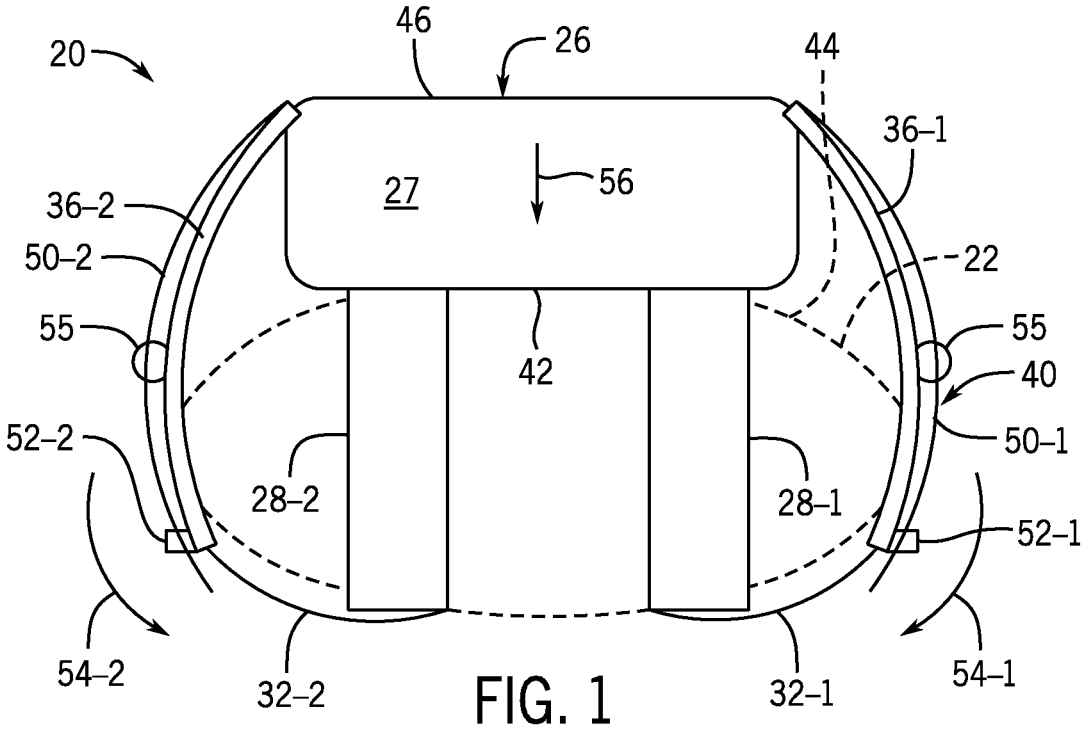
FIG. 1 is a diagram schematically illustrating portions of an example pack while being worn.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION OF EXAMPLES

Disclosed are example packs that offer adjustable fit and adjustable load compression. The example packs include a main compartment cinching system that facilitates cinching of the pack to a tight customized fit for the runner or person wearing the pack. Similar to the cinching of a saddle on a horse, the cinching of the pack allows the pack more closely move with the runner or hiker during a run or hike. The main compartment cinching system further facilitates compression of the articles, the load, carried within the pack behind the runner, reducing movement of the articles within the pack during a run or hike. In contrast to some packs, which require any compression of the load to be done prior to donning of the pack or which require separate systems and actions for such cinching and load compression; the example main compartment cinching systems are configured such that a person, while wearing the pack, may concurrently achieve both cinching and load compression through the simple manipulation of left and right cinch cords. As a result, adjusting the fit and adjusting the compression of the load may both be easily performed in a few simple actions even while the person is engaged in running or hiking.

Disclosed are example packs having a main compartment cinching system that draws and compresses the rear side of the main compartment of the pack towards the back of the person, concurrently compressing the load contained within the pack, and cinching up the pack for a tight fit customized to the person's anatomy. In some implementations, the example packs include left and right cinch cords which are each connected to the main compartment at first and second locations proximate the rear side of the main compartment. The left and right cinch cords extend along the left and is right sides of the pack, below the left and right arms of the person wearing the pack, and through left and right cinch cord retainers, such as cord locks, respectively, which are secured to the pack. While wearing the pack, the person may simply pull on such cinch cords to draw and compress the rear side of the main compartment against the person's back. The cinched and compressed state of the pack is maintained by the cord locks. Release of the cord locks allows the main compartment to expand and allows a looser fit of the pack.

In some implementations, each of the left and right cinch cords is additionally connected to a front side of the main compartment at third and fourth locations above the first and second locations. In some implementations, each of the left and right cinch cords is additionally connected to the left and right sides of the pack at fifth and six locations proximate the front side of the main compartment and below the first and second locations. In some implementations, the left and right cinch cords are slidable through left and right sleeves connected to the main compartment at the first and second locations, respectively. In some implementations, the left cord lock is vertically between the first location and the fifth location, while the right cord lock is vertically between the second location and the sixth location.

In some implementations, the left and right sides of the pack additionally include left and right pockets for receiving free ends or pull portions of the left and right cinch cords, respectively. In some implementations, the rear side of the main compartment is spaced from the front side by an uncompressed compartment thickness, wherein the left cinch cord and the right cinch cord each extend along at least 75% of the uncompressed compartment thickness.

Disclose is an example pack comprising a main compartment to extend along a back of a person wearing the pack, wherein the main compartment has a front side to extend proximate the back of the person and a rear side to extend distant the back of the person. The pack may include left and right compression panels and a main compartment cinching system. The left and right compression panels extend along the left and right sides of the person, respectively, to the rear side of the main compartment. The compartment cinching system has left and right cinch cords and left and right cinch cord retainers located along left and right sides of the person, respectively, when the pack is worn. The left or right cinch cords are pullable to concurrently compress the main compartment and cinch the left and right compression panels about a torso of the person.

Disclosed is an example pack comprising a main compartment to extend along a back of a person wearing the pack, the main compartment having a front side to extend proximate the back of the person and a rear side to extend distant the back of the person. The example pack may further comprise left and right shoulder supports coupled to the main compartment to extend over the shoulders of the person and left and right chest panels coupled to the main compartment to extend along the left and right sides of the person below left and right arms, respectively, of the person. The left and right chest panels are joined along a front of the person and connect to the left and right shoulder supports. The example pack may further comprise a main compartment cinching system to draw and compress the rear side of the main compartment towards the back of the person. The main compartment cinching system may comprise a left cord lock secured to the left chest panel, a left cinch cord connected to the main compartment at a first location proximate the rear side of the main compartment and extending through the left cord lock and along the left chest panel, a right cord lock secured to the right chest panel, and a right cinch cord connected to the main compartment at a second location proximate the rear side of the main compartment and extending through a right cord lock and along the right chest panel.

Disclosed is an example pack that may comprise a main compartment to extend along a back of a person wearing the pack, the main compartment having a front side to extend proximate the back of the person and a rear side to extend distant the back of the person. The example pack may further comprise left and right shoulder supports coupled to the main compartment to extend over the shoulders of the person, and left and right chest panels coupled to the main compartment to extend along the left and right sides of the person below left and right arms, respectively, of the person. The left and right chest panels are joined along a front of the person and connect to the left and right shoulder supports. The example pack also comprises a main compartment cinching system to draw and compress the rear side of the main compartment towards the back of the person. The main compartment cinching system may comprise left and right cinch cords having pull portions at the front of the pack and pullable to draw a rear face of the main compartment towards the back of the person wearing the pack to compress the main compartment.

FIG. 1 is a diagram schematically illustrating a top view of an example pack 20 being worn by a person 22. Pack 20, sometimes referred to as a backpack, running pack or endurance vest, offers adjustable fit and adjustable load compression. The example pack 20 comprises a main compartment cinching system that facilitates cinching of the pack to a tight customized fit for the runner or person wearing the pack such that the pack more closely moves with the runner or hiker during a run or hike. The main compartment cinching system further facilitates compression of the articles, the load, carried within the pack behind the runner, reducing movement of the articles within the pack during a run or hike. In contrast to some packs, which require any compression of the load to be done prior to donning of the pack or which require separate systems and actions for such cinching and load compression; the example main compartment cinching system of pack 20 is configured such that a person, while wearing the pack, may concurrently achieve both cinching and load compression through the simple manipulation of left and right cinch cords. As a result, adjusting the fit and adjusting the compression of the load may both be easily performed in a few simple actions even while the person is engaged in running or hiking.

Pack 20 comprises a main compartment 26, left and right shoulder supports 28-1, 28-2 (collectively referred to as shoulder supports 28), left and right chest panels 32-1, 32-2 (collectively referred to as chest panels 32), left and right compression panels 36-1, 36-2 and a main compartment cinching system 40. Main compartment 26 comprises a pouch, chamber or other volume defined by one or more panels of flexible and bendable material, such as various fabrics, polymers, leathers, synthetic leathers or the like. Main compartment 26 has a front side 42 configured to extend along a back 44 of person 22 wearing pack 20. Main compartment 26 has a rear side 46 configured to extend distant the back 44 of person 22, facing away from the face of the person 22 wearing pack 20. Although illustrated as generally rectangular in shape, main compartment 26 may be cylindrical or may have other shapes and/or relative sizes.

Shoulder supports 28 are coupled to main compartment 26 and are configured to extend over the shoulders of the person 22 when pack 20 is being worn. In the example illustrated, shoulder supports 28 are connected to front side 42 of main compartment 26. In some implementations, shoulder supports 28 may have an adjustable length. Shoulder supports 28 can also include one or more layers of padding material.

Left and right chest panels 32-1, 32-2 extend from the left and right shoulder supports 28-1, 28-2, respectively. In some implementations, chest panels 32 extend over and cover the majority, if not substantially all of, the breasts or chests of the person 22 wearing pack 20. In some implementations, chest panels 32 merely comprise extensions of shoulder supports 28, wherein both the shoulder supports 28 and chest panels 32 comprise an elongate strap that extends from main compartment 26, across the shoulders of person 22 and across the sides of the chest of person 22, to the sides of the person 22, at or below the armpit or shoulders of the person 22. This elongate strap may be formed from a single expansive material or multiple expansive material stitched or otherwise joined to one another. The chest panels 32 may also include one or more layers of padding material. In the example illustrated, chest panels 32-1 and 32-2 have end portions fixed or secured to compression panels 36-1 and 36-2, respectively. Chest panels 32 are not directly connected to main compartment 26. In some implementations, left chest support 32-1 and right chest support 32-2 may be releasably connected to one another by a sternum connector.

Left and right compression panels 36-1 and 36-2 are coupled to left and right chest panels 32-1 and 32-2, respectively. Compression panels 36-1 and 36-2 extend along the left and right sides of the person 22, respectively, below the armpits or arms of person 22, to the rear side 46 of main compartment 26. Compression panels 36 are formed from a flexible or deformable material, such as a fabric, polymer, leather, synthetic leather or the like. In the example illustrated, compression panel 36-1 has a first end portion stitched or otherwise secured to an end portion of chest panel 32-1 and a second end portion stitched or otherwise joined to main compartment 26 proximate to rear side 46 of main compartment 26. In the example illustrated, compression panel 36-2 has a first end portion stitched or otherwise secured to an end portion of chest panel 32-2 and a second end portion stitched or otherwise joined to main compartment 26 proximate to rear side 46 of main compartment 26.

In some implementations, compression panel 36 may comprise a single strap or multiple vertically spaced straps connected to vertically spaced portions of rear side 46 or the respective lateral sides of main compartment 26 proximate to rear side 46. In some implementations compression panel 36 may comprise a continuous expanse of material vertically extending along and connected to office respective lateral sides of main compartment 26 proximate to rear side 46 or to rear side 46 of main compartment 26 along substantially the entire vertical length or height of main compartment 26.

Main compartment cinching system 40 is configured to draw and compress the rear side 46 of the main compartment 26 of the pack towards the back 44 of the person 22, concurrently compressing any load contained within main compartment 26 and cinching up the pack 20 for a tight fit customized to the anatomy of person 22. Such cinching may result in the front side 42 of main compartment 26 bending and more tightly fitting against the back 44 of person 22. Such cinching may further pull compression panels 36 and/or chest panels 32 further forward about the sides of person 22 and further across the front of person 22 such that pack 20 more closely conforms to the shape of person 22 and moves with person 22 as person 22 is running or hiking.

Main compartment cinching system 40 comprises left and right cinch cords 50-1, 50-2 (collectively referred to as cinch cords 50) and left and right cinch cord retainers 52-1, 52-2 (collectively referred to as cinch cord retainers 52). Left and right cinch cords 50 are coupled to left and right compression panels 36-1 and 36-2, respectively, such that the pulling of cinch cords 50-1, 50-2 in the directions indicated by arrows 54-1 and 54-2, respectively, also pulls compression panels 36-1 and 36-2 about the sides of person 22 in the same directions. In some implementations, cinch cords 50 may be affixed to or otherwise transfer forces the sides of compression panels 36 at various locations. In some implementations, cinch cords 50 may be further connected to main compartment 26 (or portions of compression panels 36) proximate to main compartment 26, at locations along the rear side 46 of main compartment 26 or at sides of main compartment 26 proximate to rear side 46. In some implementations, cinch cords 50 may include portions which slide along and within sleeves, rings, loops, or other guides affixed to or the provided by the material forming compression panels 36.

Cinch cord retainers 52-1, 52-2 comprise structures configured to releasably retain cinch cords 50-1, 50-2, respectively, in a selected state having a selected overall length between the particular cord retainer 52 and the rear side 46 of main compartment 26. Cinch cord retainers 52 maintain a particular established degree of compression of main compartment 26 and cinching of pack about the person 22. Cinch retainers 52 are fixedly coupled to pack at locations such that cinch cord retainers 52 or those portions of cinch cords 50 connected to cinch cord retainers 52 may be manipulated by person 22 while pack 20 is being worn by person 22. As a result, the compression of main compartment 26 and the cinching of pack 20 may be adjusted while the person 22 is wearing pack 20 and even while the person is running or hiking. In some implementations, cinch cord retainers 52 are coupled to pack 20 forward of front side 42 of main compartment 26. In the example illustrated, cinch cord retainers 52 are coupled to pack 20 at locations below the armpits or forward the armpits when pack 20 is being worn by person 22.

In some implementations, cinch cord retainers 52 each comprise cord locks. In some implementations, cinch cord retainers 52 may each comprise other structures for releasably retaining and securing a portion of a cinch cord 50-1, 50-2 in place relative to the location at which the cinch cord retainer 52 is affixed to pack 20. For example, in some implementations, cinch cord retainers 52-1, 52-2 may comprise a ring, loop or other structure formed by or affixed to pack 20 at a location which allows person 22 to tie the respective cinch cord 50-1, 50-2 to the ring, loop or other structure.

In one example scenario, person 22 may don (put on) pack 20, extending his or her arms through shoulder supports 28 with his or her arms extending over portions of chest supports 32 and/or compression panels 36. Such donning may be done while main compartment 26 is in an uncompressed state and while compression panels 36 are also loose or extended. In preparation for a run or hike, person 22, while wearing pack 20 may manipulate cinch cord retainers 52 and cinch cords 50 to pull cinch cords 50-1 and 50-2 forwardly in the directions indicated by arrows 54-1 and 54-2, respectively. Such pulling results in rear side 46 of main compartment 26 being pulled forwardly in the direction indicated by arrow 56, compressing any articles or load within the interior 27 of main compartment 26. Such pulling of cinch cords 50 further results in the front side 42 of main compartment 26 bending to a concave shape conforming to the back 44 of person 22. Such pulling of cinch cords 50 further results in compression panels 36 more closely wrapping about the sides or torso of person 22, cinching up pack 20 with respect to the particular anatomy of person 22. Once at a proper or desired degree of load compression and a proper or desired degree of cinching, cinch cords 50 may be retained in place to further manipulation of cinch cord retainers 52. Cinch cords 50 facilitate different degrees of cinching and different degrees of compression on the left and right sides of person 22, allowing pack 20 to be differently adjusted to accommodate preferences of person 22 or different load distributions within main compartment 26.

Following a run or hike, person 22 may manipulate cinch cord retainers 52 and/or cinch cords 50 such that the extent/effective length of cinch cords 50 between cinch cord retainers 52 and the rear side 46 of main compartment 26 (and the distance separating the front side 42 from the rear side 46) may be increased or lengthened, reducing the degree of compression of main compartment 26 and loosening compression panels 36. Such decompression and un-cinching may facilitate the extraction of articles from the interior 27 of main compartment 26 while pack 20 is being worn. Such decompression and un-cinching may further facilitate the removal of pack 20 by person 22.

Figure 2:
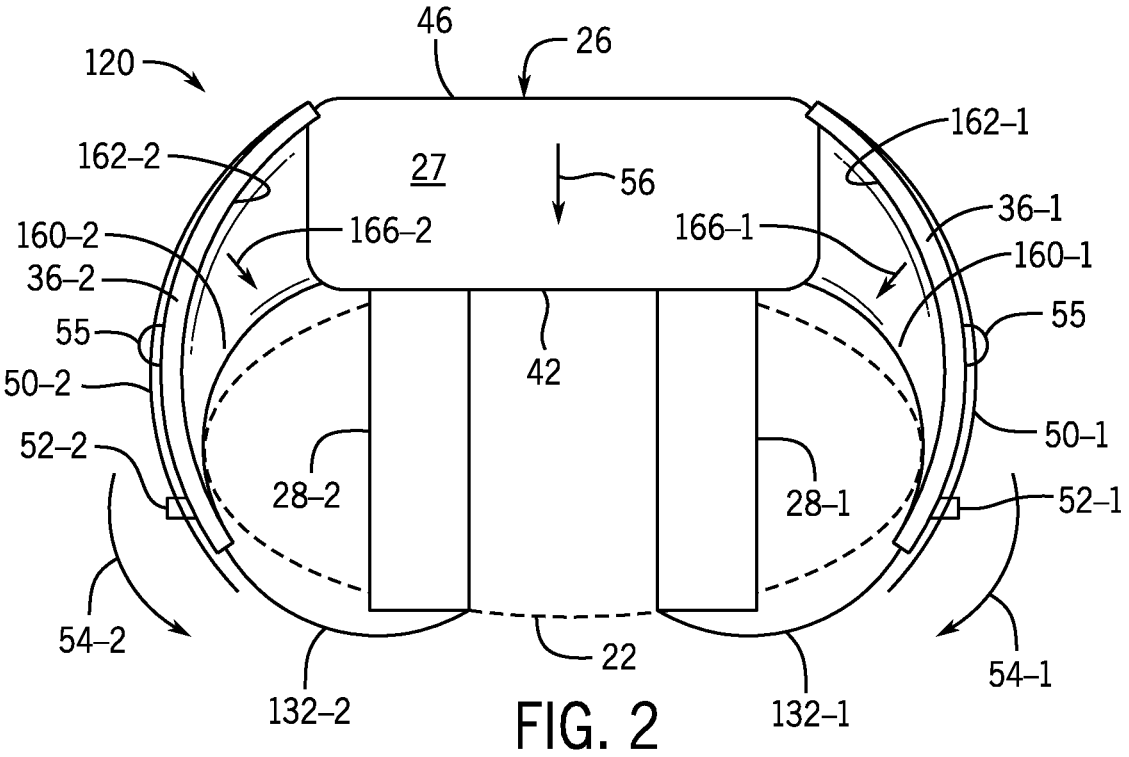
FIG. 2 is a diagram schematically illustrating portions of an example pack while being worn.

FIG. 2 is a diagram schematically illustrating a top view of an example pack 120 being worn by a person 22. Like pack 20, the construction of pack 120 facilitates the simultaneous or concurrent load compression and cinching through relatively simple manipulation of cinch cords while the person is wearing the pack. Pulling a single first cinch cord achieves both load compression and cinching on one side of the pack. Pulling a single second cinch cord achieves both load compression and cinching on the other side of the pack. Pulling both cords at the same time results in both load compression and cinching on both sides of the pack.

Pack 120 additionally provides left and right side pockets for additional storage. Such side pockets are formed by the already provided compression panels, adding additional storage in an efficient manner without adding excessive amounts of material or weight. In addition, such side pockets are also compressible by the same manipulations used to achieve load compression and cinching. Pack 120 is similar to pack 20 described above except that pack 120 comprises chest panels 132-1 and 132-2 (collectively referred to as chest panels 132). Those remaining components of pack 120 which correspond to components of pack 20 are numbered similarly.

Chest panels 132 are similar to chest panels 32 described above except that chest panels 132 do not terminate at front end portions of compression panels 36, but instead continue to extend or wrap around the sides of person 22 for connection to main compartment 26. In the example illustrated, chest panels 132-1 and 132-2 wrap about the sides of person 22, below the armpits of person 22 wearing pack 120 locations where chest panels 132-1 and 132-2 are connected to the left and right of main compartment 26. In some implementations, portions of chest panels 132 may include expanses of elastic material for closely conforming to the sides of person 22.

In the example illustrated, compression panels 36 may be secured to chest panels 132 at locations below the armpits of person 22 or forward the armpits of person 22, proximate to cinch cord retainers 52. In the example illustrated, portions of chest panels 132 and compression panels 36 are spaced and have underlying floors 160-1 and 160-2 to form left and right side pockets 162-1 in 162-2, respectively. In some implementations, the expanse of material forming compression panel 36-1 may extend to and connect to chest panel 132-1 to form floor 160-1 of pocket 162-1. In some implementations, the expanse of material forming chest panel 132-1 may extend to and connect to compression panel 36-1 to form floor 160-1 of pocket 162-1. In some implementations, a separate additional panel or expansive material may be stitch otherwise secured to the lower edges of each of chest panel 132-1 and compression panel 36-1 to form the floor 160-1 of pocket 162-1. The right side pocket 162-2 may be formed in similar fashions.

In one example scenario, person 22 may don (put on) pack 120, extending his or her arms through shoulder supports 28 with his or her arms extending over portions of chest supports 32 and/or compression panels 36. Such donning may be done while main compartment 26 is in an uncompressed state and while compression panels 36 are also loose or extended. In preparation for a runner hike, person 22, while wearing pack 120 may manipulate cinch cord retainers 52 and cinch cords 50 to pull cinch cords 50-1 and 50-2 forwardly in the directions indicated by arrows 54-1 and 54-2, respectively. Such pulling results in rear side 46 of main compartment 26 being pulled forwardly in the direction indicated by arrow 56, compressing any articles or load within the interior 27 of main compartment 26. Such pulling of cinch cords 50 further results in the front side 42 of main compartment 26 bending to a concave shape conforming to the back 44 of person 22. Such pulling of cinch cords 50 further results in compression panels 36 more closely wrapping about the sides or torso of person 22, cinching up pack1 20 with respect to the particular anatomy of person 22.

Such pulling of cinch cords 50 further results in rearward portions of compression panels 36 being drawn inwardly as indicated by arrows 166-1 in 166-2 so as to compress any articles within pockets 162-1 and 162-2. Such pulling may further result in compression panels 36 tightly gripping any articles projecting from pockets 162-1 or 162-2 to resist accidental dislodgment of such articles from pockets 162-1, 162-2.

Once at a proper or desired degree of load compression and a proper or desired degree of cinching, cinch cords 50 may be retained in place to further manipulation of cinch cord retainers 52. Cinch cords 50 facilitate different degrees of cinching and different degrees of load compression for main compartment 26 and pockets 162 on the left and right sides of person 22, allowing pack 20 to be differently adjusted to accommodate preferences of person 22 or different load distributions within main compartment 26 or pockets 162. While pack 120 is being worn by person 22, person 22 may manipulate cinch cord retainers 52 and/or cinch cords 50 to lessen the tension of compression panels 36 to facilitate the withdrawal of articles from one or both of pockets 162.

Figure 3:
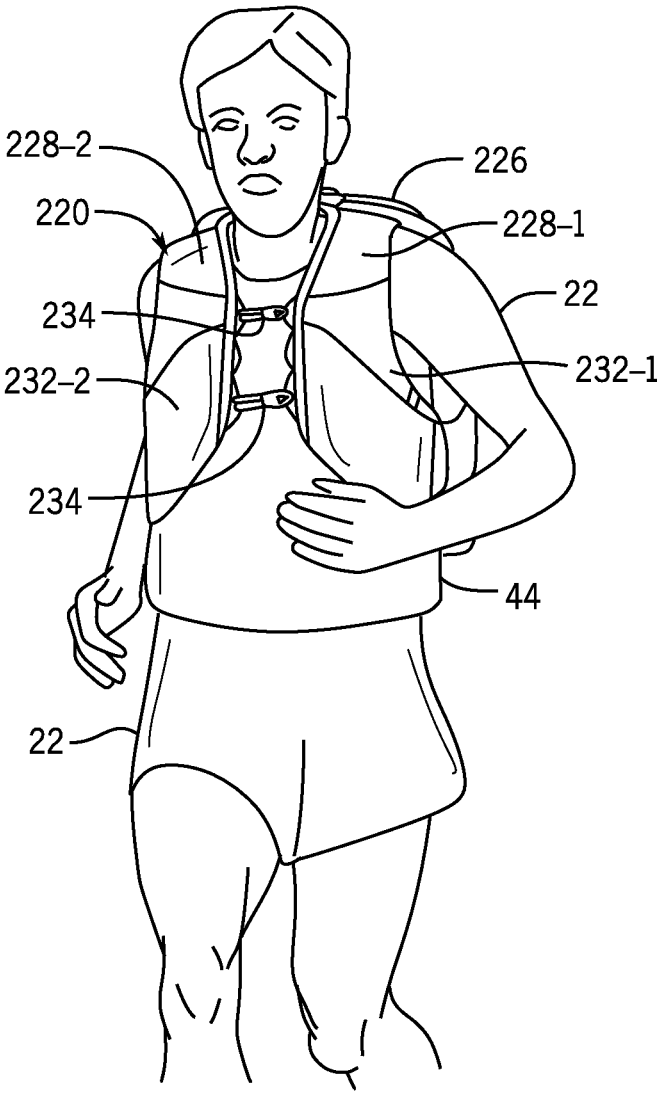
FIG. 3 is a perspective view of an example pack while being worn.

FIGS. 3-15 illustrate an example pack 220. FIGS. 3-15 illustrate a particular example implementation of pack 120 described above. FIG. 3 illustrates pack 220 worn by a person 22 while running. FIGS. 3-9 illustrate various views of pack 220. FIGS. 10-15 illustrate an example main compartment cinching system of pack 220. Pack 220 comprises main compartment 226, shoulder supports 228-1, 228-2 (collectively referred to as shoulder supports 228), left and right chest panels 232-1, 232-2 (collectively referred to as chest panels 232), sternum connectors 234, left and right compression panels 236-1, 236-2, and main compartment cinching system 240.

Main compartment 226 comprises a pouch, chamber or other volume defined by one or more panels of flexible and bendable material, such as various fabrics, polymers, leathers, synthetic leathers or the like. Main compartment 226 has a front side 242 configured to extend along a back 44 of person 22 wearing pack 220. Main compartment 226 has a rear side 246 configured to extend distant the back 44 of person 22, facing away from the face of the person 22 wearing pack 220. Although illustrated as generally rectangular in shape, main compartment 226 may be cylindrical or may have other shapes and/or relative sizes.

Shoulder supports 228 are coupled to main compartment 226 and are configured to extend over the shoulders of the person 22 when pack 220 is being worn. In the example illustrated, shoulder supports 228 are connected to front side 242 of main compartment 226. In some implementations, shoulder supports 228 may have an adjustable length.

Figure 4:
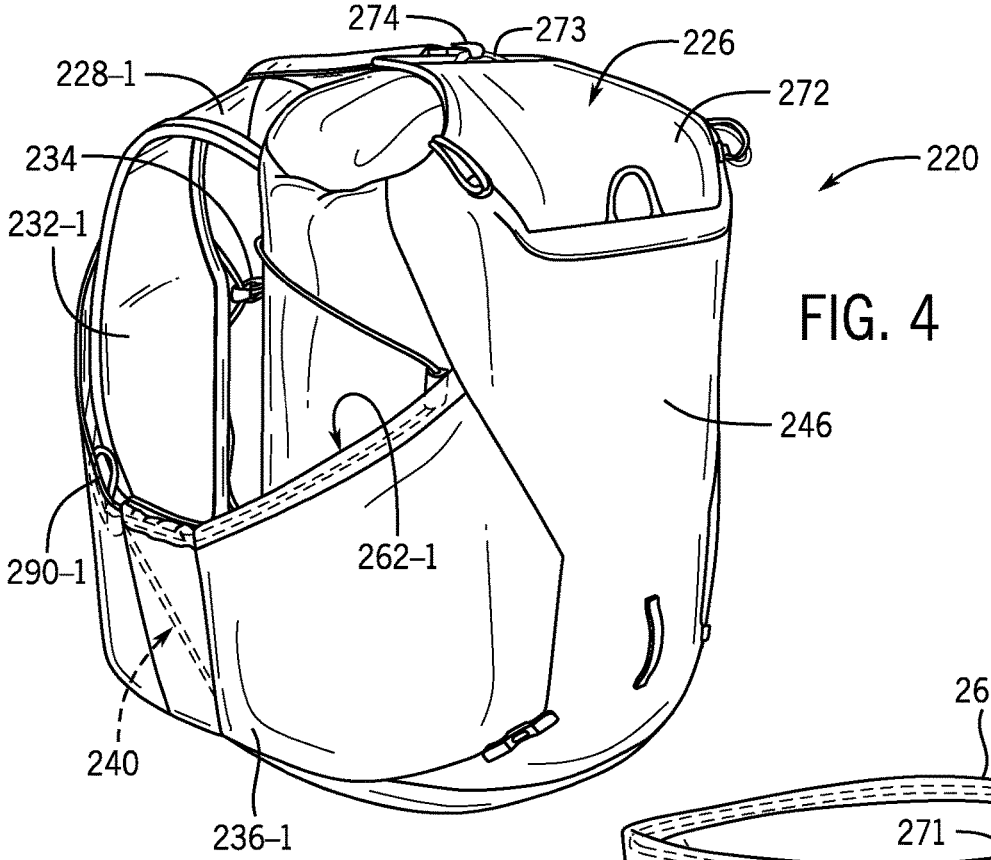
FIG. 4 is a front perspective view of the pack of FIG. 1.
Figure 5:
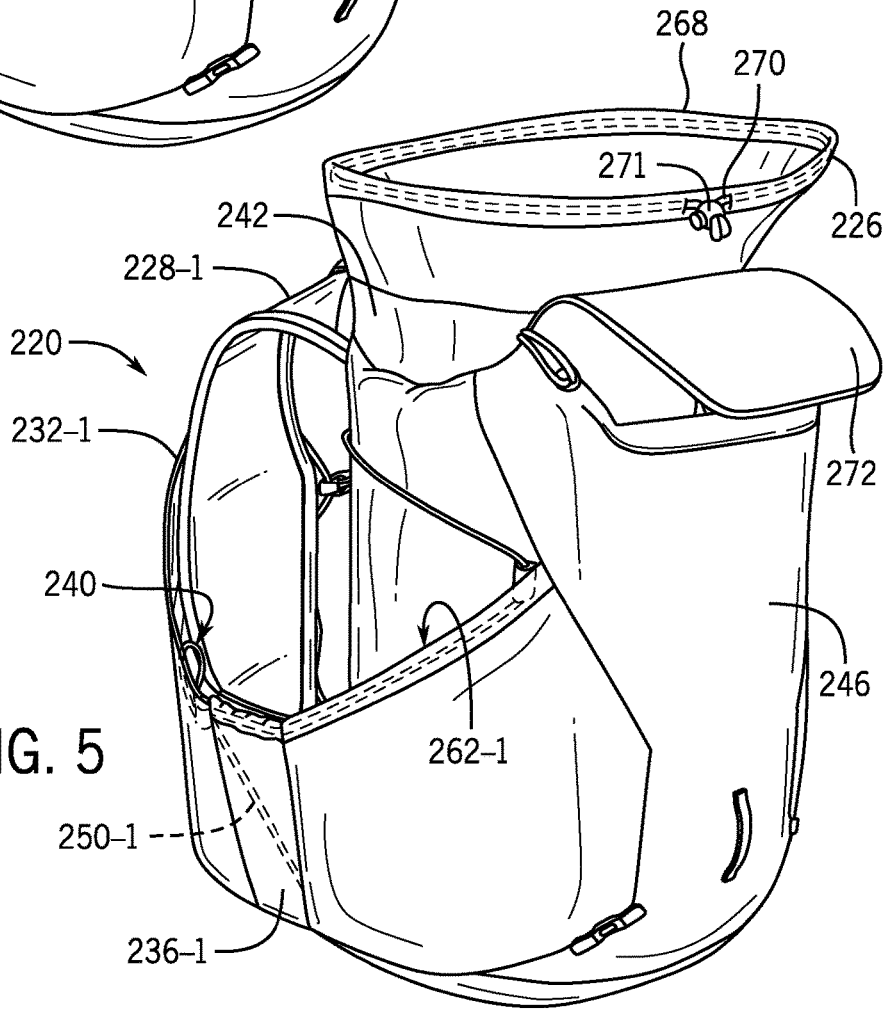
FIG. 5 is a rear perspective view of the pack of FIG. 1.
Figure 8:
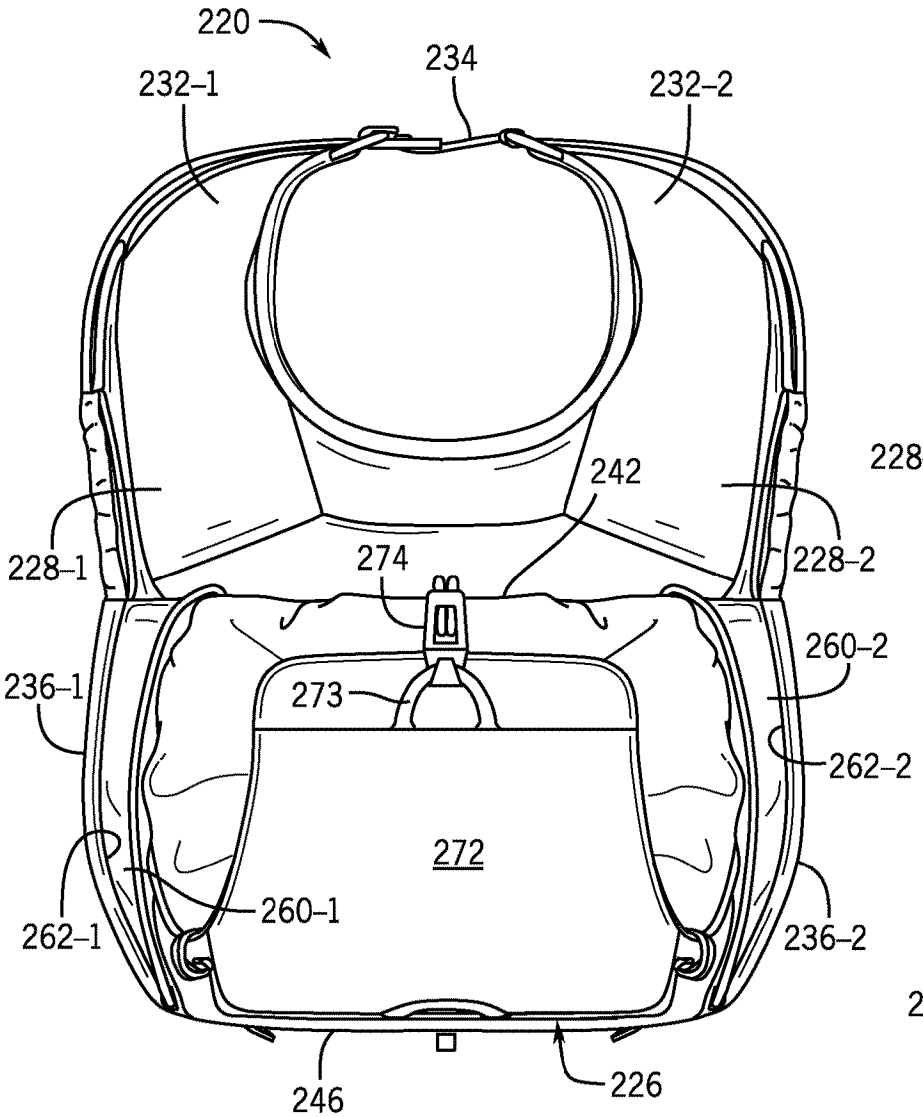
FIG. 8 is a top view of the pack of FIG. 1.

As shown by FIGS. 4 and 5, main compartment 226 comprises a top opening or mouth 268 along which a drawstring 270 extends to close mouth 268. In the example illustrated, drawstring 270 may be retained in a closed state by a cord lock 271. The closed mouth 268 may be further covered by cover flap 272 extending from the top of rear side 246. As shown by FIGS. 4 and 8, cover flap 272 may be releasably secured in a mouth in a covering state by hooking the ring or loop 273 of cover flap 272 with the hook 274 which is secured at the front side 242 of main compartment 226.

Left and right chest panels 232-1, 232-2 extend from the left and right shoulder supports 228-1, 228-2, respectively. In the illustrated example, chest panels 232 extend over and cover the majority, if not substantially In all of, the chest or breasts of the person 22 wearing pack 220. In the example illustrated, chest panels 232 comprise extensions of shoulder supports 228, wherein the expansive material forming shoulder supports 228 continues without interruption to form portions of chest panels 232. In other implementations, shoulder supports 228 and the adjacent portions of chest panels 232 may be formed from different expanses of material which are joined to another by stitching or the like.

As shown by FIG. 14, right chest panel 232-2 extends from shoulder support 228 along the front of person 22, across the breast or chest of person 22, and along the sides of the chest or breasts of person 22, to the sides of the person 22, at or below the armpit 221 or right shoulder 223 of the person 22. As shown by FIG. 15, right chest panel 232-2 further extends along the right side 235 of person 22 to a location proximate to the front side 242 of main compartment 226 where is connected to main compartment 226 by stitching, welds, adhesives, or the like. The left chest panel 232-1 has a similar construction, mirroring the construction of right chest panel 232-2. In one implementation, the left chest panel 232-1 and the right chest panel 232-2 may have a height measured in a vertical direction at a location beneath the user's armpit when the user is standing wearing the pack 220 of at least 3 inches. In another implementation, the height of the left and right chest panels 232-1 and 232-2 can be at least 4 inches. In another implementation, the height of the left and right chest panels 232-1 and 232-2 can be at least 5 inches.

Figure 7:
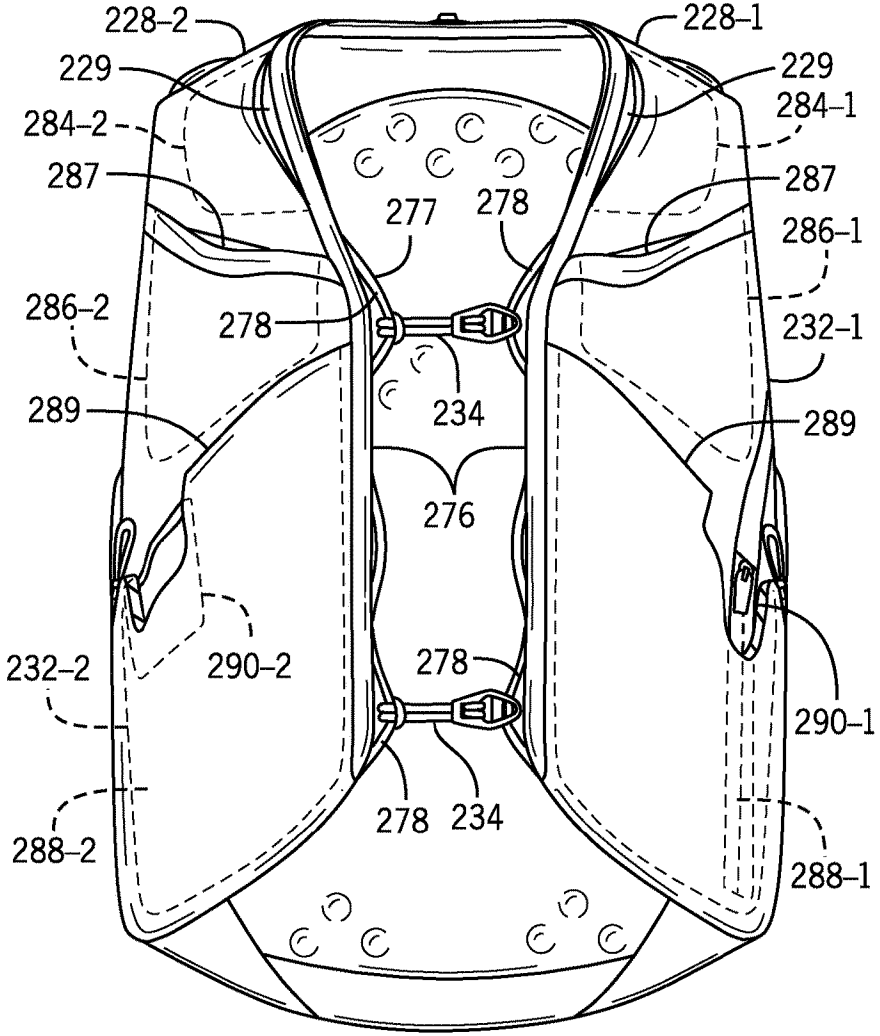
FIG. 7 is a front view of the pack of FIG. 1.
Figure 6:
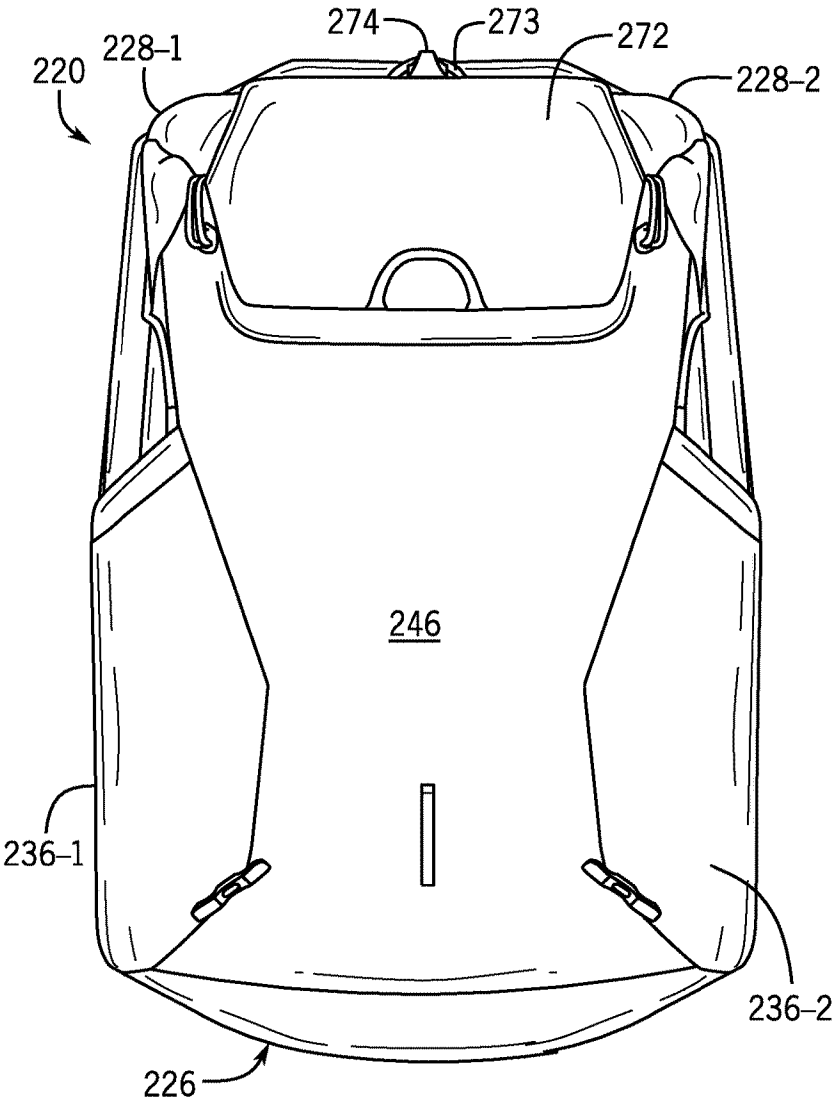
FIG. 6 is a rear view of the pack of FIG. 1.
Figure 9:
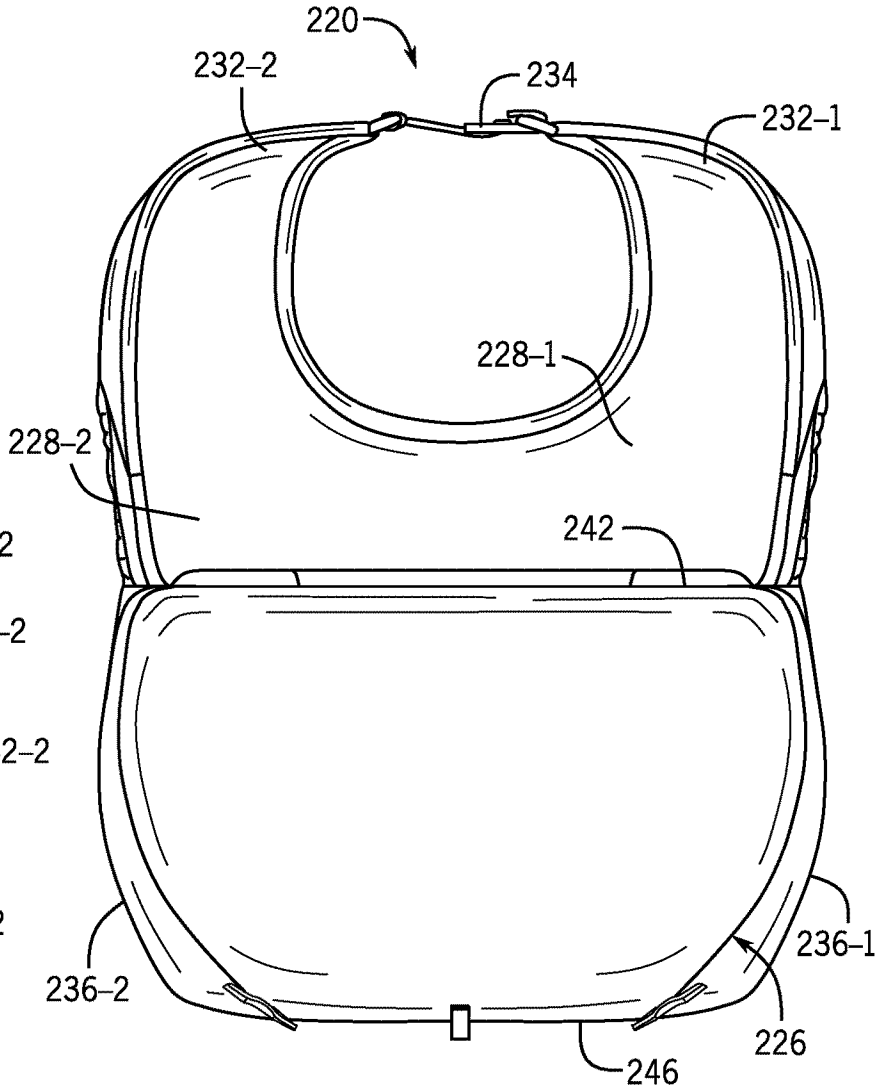
FIG. 9 is a bottom view of the pack of FIG. 1.

As shown by FIG. 7, opposite edge portions 276 of chest panels 232 include a continuous cord 277 which is stitched or sewn at intermediate locations to form loops 278 for securing sternum connectors 234. One end of each of sternum connectors 234 is secured to one of chest panel 232 by the associated loops, whereas the other end of the sternum connectors 234 is releasably connected or hooked to the loops 278 associated with the other of chest panels 232. As a result, the connected left and right chest panels 232 and the front side 242 of main compartment 226, collectively, completely encircle user 22. As should be appreciated, in other implementations, loops 278 may be formed by other structures. In still other implementations, the left and right chest panels 232 may be releasably connected to one another along the front center midline of user 22 using other mechanisms such as zippers, quick release buckles, tie strings, snaps, buttons, hook and loop fasteners or the like.

As further shown by FIG. 15, right chest panel 232-2 is composed of multiple expanses of material which are stitched or sewn to one another. Right chest panel 232-2 comprise an innermost layer formed by expanses 280 and 282 which are stitched or otherwise joined to one another. Expanses 280 and 282 may be formed from different materials having different properties. In the example illustrated, expanse 282 has a greater degree of stretchability or elasticity as compared to expanse 280, facilitating an enhanced fit about the sides of person 22. In other implementations, expanses 280 and 282 may be replaced with a single continuous expansive material or additional expanses of material which are stitched or otherwise joined to one another. Left chest panel 232-1 has a similar construction.

As shown by broken lines in FIG. 7, left and right chest panels 232 may include additional outer layers of material stitched otherwise joined to the innermost layers of material, expanse 280. The additional outer layers of material form pockets 284-1, 284-2 (collectively referred to as pockets 284), pockets 286-2, 286-2 (collectively referred to as pockets 286) pockets 288-1, 288-2 (collectively referred to as pockets 288) and pockets 290-1, 290-2 (collectively referred to as pockets 290). Pockets 284 extend proximate to shoulder supports 228-1, 228-2 and include sideways facing mouths 229. Pockets 286 extend below pockets 284 and include upwardly facing mouths 287. Pockets 288 are provided in the lowermost portions of chest panels 232 and include upwardly facing mouths 289. FIG. 15 illustrates an outer layer formed by expanse 292 which forms pockets 288-2. Pockets 290 comprise smaller pockets formed by stitching provided at the upper right and left sides of pockets 288. Pockets 290 are located and sized to receive actuation portions of main compartment cinching system 240.

Left and right compression panels 236-1 and 236-2 are coupled to left and right chest panels 232-1 and 232-2, respectively. Compression panels 236-1 and 236-2 extend along the left and right sides of the person 22, respectively, below the armpits 221 or arms of person 22, to the rear side 246 of main compartment 226. Compression panels 236 are formed from a flexible or deformable material, such as a fabric, polymer, leather, synthetic leather or the like.

As shown by FIGS. 14 and 15, right compression panel 236-2 has a first end portion 294 stitched or otherwise secured to a side of chest panel 232-2 along stitching or junction line 293 and a second end portion 296 stitched or otherwise joined to main compartment 226 proximate to rear side 246 of main compartment 226 along stitching or junction line 295. Compression panel 236-2 has a lower edge stitched or otherwise joined (adhesives, welding or the like) to expanse 282 of right chest panel 232-2 along stitching or junction line 297 and to the sides of main compartment 226 along stitching or junction line 298 to form a floor 260-2 of pocket 262-2. Floor 260-2 and pocket 262-2 are similar to floor 160-2 and pocket 162-2, respectively, of pack 120 described above. As shown by FIG. 8, left compression panel 236-1 has a similar construction as that of right compression panel 236-2, forming floor 260-2 of a pocket 262-1. As should be appreciated, any description of stitching being used to join different expanses of material or different components may alternatively be carried out with other techniques such as welding, fusing, adhesives or the like. In some implementations, such stitching may also be replaced with releasable junctions such as zippers or ZIPLOC closures.

As further shown by FIG. 15, in the example illustrated, left and right compression panels 236 are each formed from multiple distinct expanses of material stitched to one another or otherwise joined to one another. In the example illustrated, each of compression panels 236 comprises material expanse 300 and material expanse 302. Material expanse 300 extends from a location proximate to front side 242 of main compartment 226 to first and portion 294. In the example illustrated, expanse 300 has a greater degree of flexibility and elasticity as compared to expanse 302. In some implementations, expanse 300 may be formed from the same material as that of expanse 282 of chest panels 232. Expanse 300 provides a greater degree of flexibility and elasticity adjacent to and about sides 235 of person 22. Expanse 302 is stitched or otherwise joined to expanse 300 and extends rearwardly to second end portion 293 where it is stitched or otherwise joined to main compartment 226 at junction line 295. In other implementations, each of compression panels 236 may be formed from a single continuous expanse of material or may be formed from more than two expanses of material having the same or different material properties.

Main compartment cinching system 240 is configured to draw uncompressed the rear side 246 of the main compartment 226 of the pack towards the back 44 of the person 22, concurrently compressing any load contained within main compartment 226 and cinching up the pack 220 for a tight fit customized to the anatomy of person 22. Such cinching may result in the front side 242 of main compartment 26 bending and more tightly fitting against the back 44 of person 22. Such cinching may further pull compression panels 36 and/or chest panels 32 further forward about the sides of person 22 and further across the front of person 22 such that pack 220 more closely conform to the shape of person 22 and moves with person 22 as person 22 is running or hiking.

Main compartment cinching system 240 comprises left and right cinch cords 250-1, 250-2 (collectively referred to as cinch cords 250) and left and right cinch cord retainers 252-1, 252-2 (collectively referred to as cinch cord retainers 252). Left and right cinch cords 250 are coupled to left and right compression panels 236-1 and 236-2, respectively, such that the pulling of cinch cords 250-1 and/or 250-2 in in a forward direction, also pulls compression panels 236-1 and 236-2 about the sides of person 22 in the same directions. In some implementations, cinch cords 250 may be affixed to or movable along the sides of compression panels 36 at various locations and in various manners.

Cinch cord retainers 252-1, 252-2 comprise structures configured to releasably retain cinch cords 250-1, 250-2, respectively, in a selected state having a selected overall length between the particular cord retainer 252 and the rear side 246 of main compartment 226. Cinch cord retainers 252 maintain a particular established degree of compression of main compartment 226 and cinching of pack 220 about the person 22. Cinch retainers 252 are fixedly coupled to pack at locations such that cinch cord retainers 252, or those portions of cinch cords 250 connected to cinch cord retainers 252, may be manipulated by person 22 while pack 220 is being worn by person 22. As a result, the compression of main compartment 226 and the cinching of pack 220 may be adjusted while the person 22 is wearing pack 220 and even while the person is running or hiking. In some implementations, cinch cord retainers 252 are coupled to pack 220 forward of front side 242 of main compartment 226. In the example illustrated, cinch cord retainers 252 are coupled to pack 220 at locations below the armpits or forward the armpits 221 when pack 220 is being worn by person 22.

In some implementations, cinch cord retainers 252 each comprise cord locks. In some implementations, cinch cord retainers 252 may each comprise other structures for releasably retaining and securing a portion of a cinch cord 250-1, 250-2 in place relative to the location at which the cinch cord retainer 52 is affixed to pack 220. For example, in some implementations, cinch cord retainers 252-1, 252-2 may comprise a ring, loop or other structure formed by or affixed to pack 220 at a location which allows person 22 to tie the respective cinch cord 250-1, 250-2 to the ring, loop or other structure.

Figure 10:
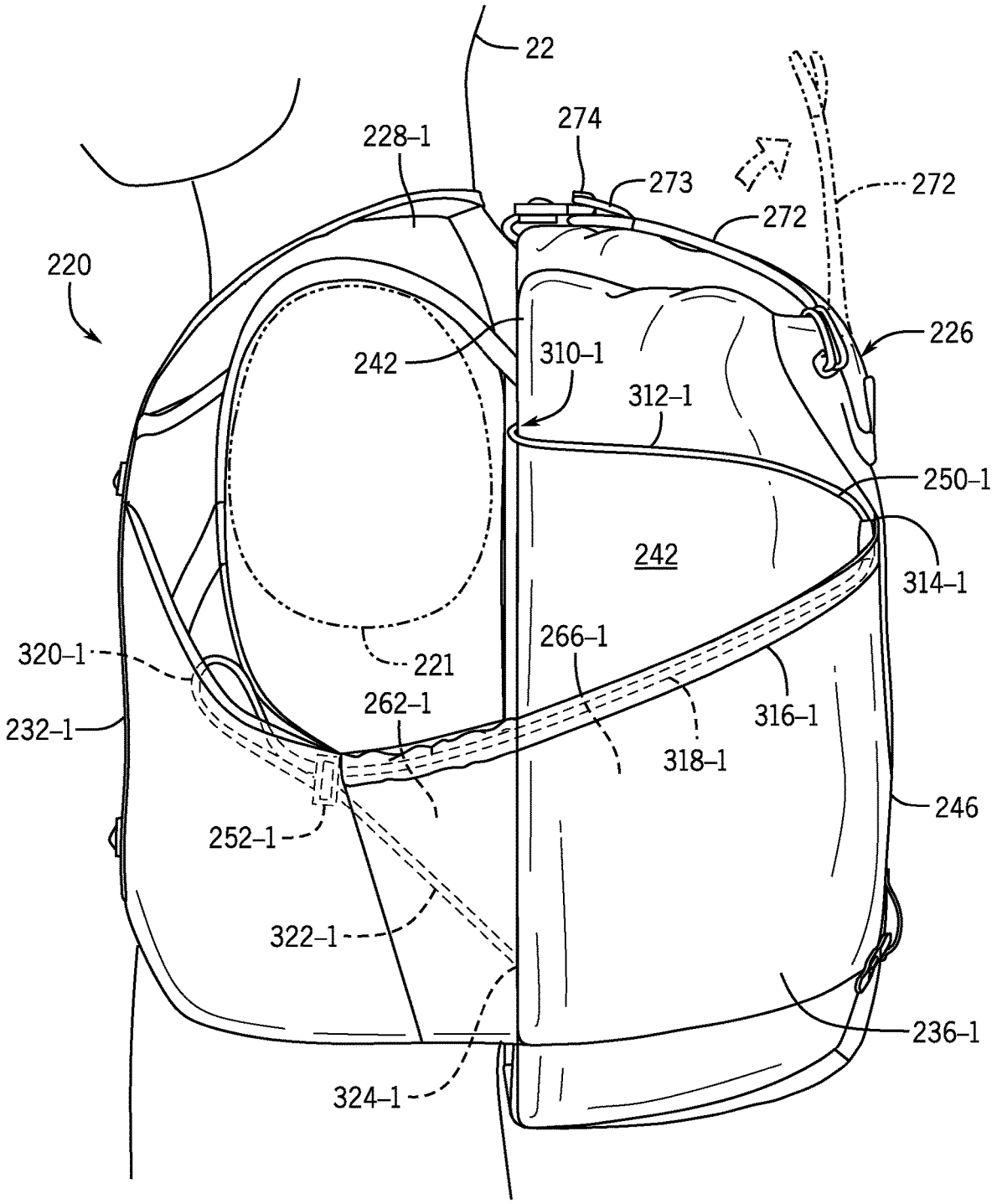
FIG. 10 is a left side view of the pack of FIG. 1 being worn.

FIGS. 10 and 14 illustrate one example routing of left and right cinch cords 250. FIG. 10 illustrates an example routing of left cinch cord 250-1. FIG. 14 illustrates an example routing of cinch cord 250-2. The left or right cinch cords 250-1, 250-2 have routings that mirror one another on opposite sides of pack 220. In other implementations, cinch cords 250 may have different routings or may be different from one another.

As shown by FIG. 10, cinch cord 250-1 has a first end portion 310-1 secured to the remainder of pack 220 at a location proximate to front side of main compartment 226. Cinch cord 250-1 has a first intermediate portion 312-1 loosely extending along the left side 242 of main compartment 226 to an entrance point 314 of sleeve 316. Intermediate portion 312-1 extends across substantially an entire uncompressed thickness of main compartment 226 from front side 242 to rear side 246. As result, an entire thickness of the upper portion of main compartment 226 maybe compressed through the pulling of cinch cord 250-1.

Cinch cord 250-1 has a second intermediate portion 318-1 (shown broken lines) which extends from through sleeve 316-1 to cinch cord retainer 252-1. Sleeve 316-1 extends along the upper perimeter edge of compression panel 336-1. As a result, in response to cinch cord 250-1 being pulled, intermediate portion 318-1 of cinch cord 250-1 applies a force to the upper edge of compression panel 236-1, drawing compression panel 236-1 both forwardly and inwardly, reducing the size of pocket 266-1.

Cinch cord 250-1 has a pulling portion 320-1 which comprises that portion of cinch cord 250-1 that extends from intermediate portion 318-1 through cinch cord retainer 252-1 and which returns back through cinch cord retainer 252-1. Pulling portion 320 forms a loop for being grasped manually by the person wearing pack 220. The actual size of pulling portion 320 may vary depending upon the extent that cinch cord 250-1 has been pulled through cinch cord retainer 252-1. Pulling portion 320 is located such that pulling portion 320 may be inserted into and concealed within a corresponding pocket of left chest panel 232-1. In the example illustrated, pocket 290-1 is located and sized to receive and conceal pulling portion 320-1.

Cinch cord 250-1 includes intermediate portion 322-1 which extends from cinch cord retainer 252-1 to an end portion 324-1 which is affixed or otherwise secured to pack 20 at a location proximate to the rear side 242 of main compartment 226 and proximate to the bottom of main compartment 226. In the example illustrated, intermediate portion 322-1 extends within and is concealed within pocket 262-1. As shown by FIG. 14, the right cinch cord 250-2 has a similar route.

Figure 12:
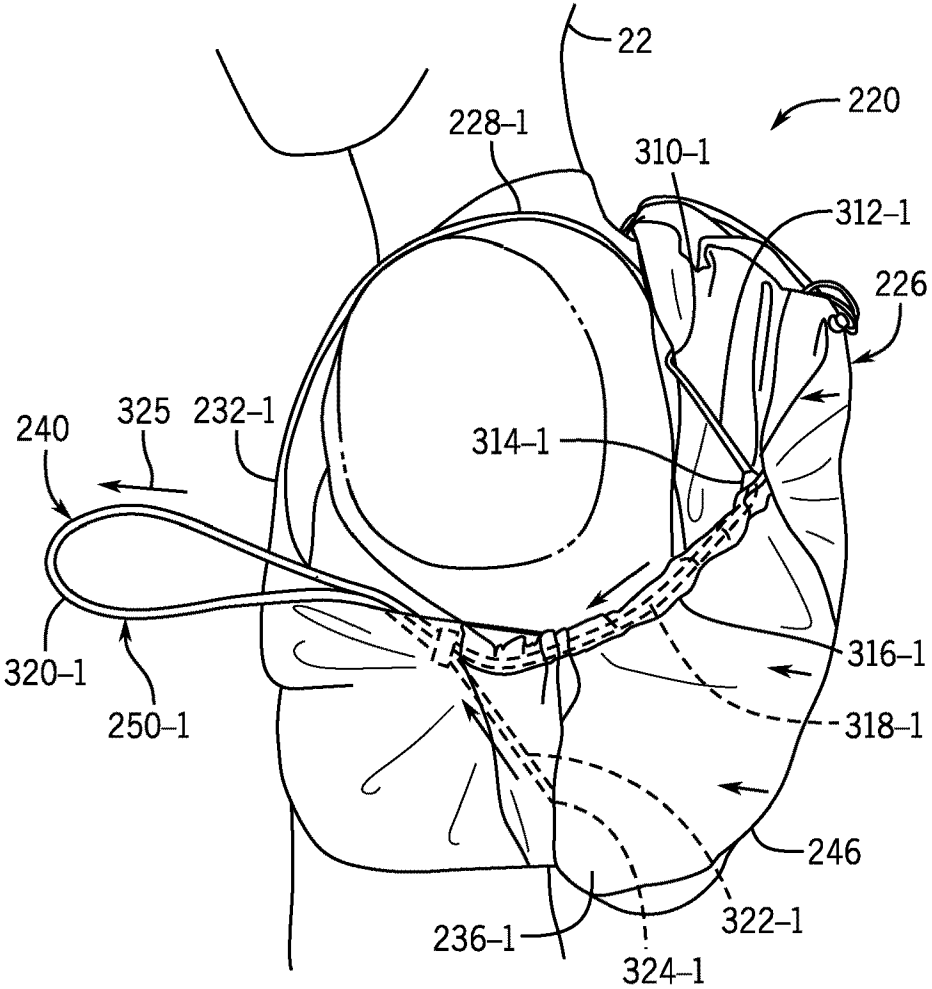
FIG. 12 is a left side view of the pack of FIG. 1 undergoing load compression and cinching while being worn.
Figure 11:
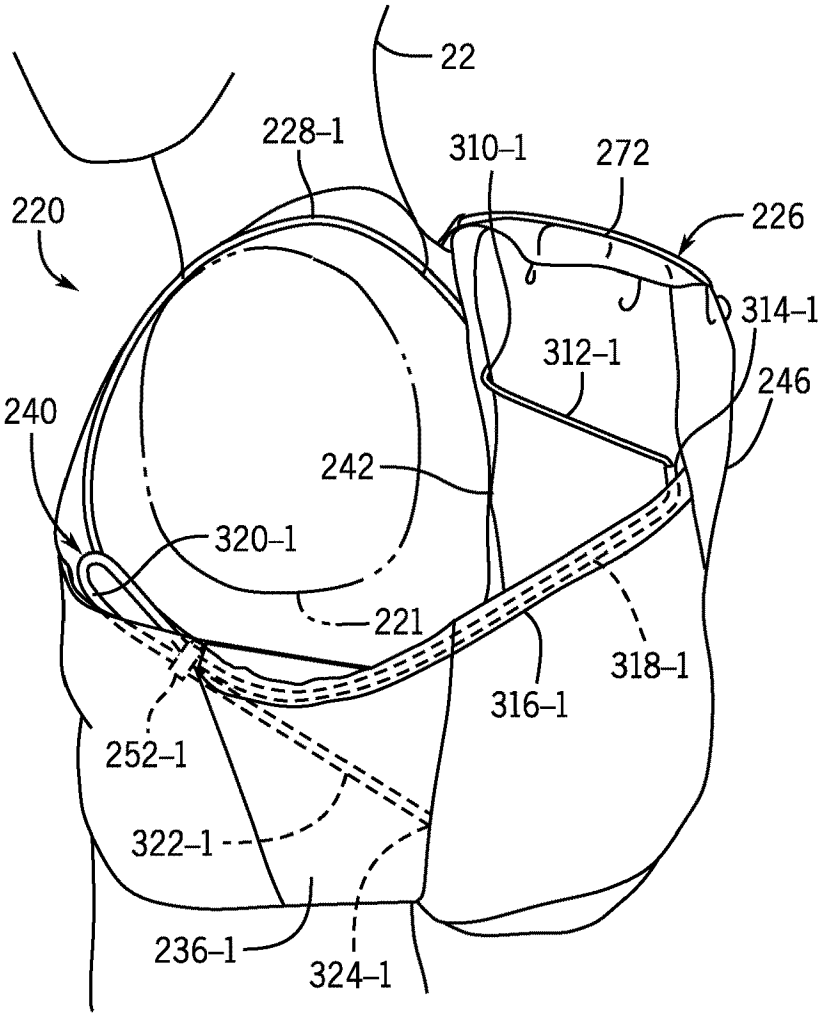
FIG. 11 is a left side view of the pack of FIG. 1 being worn.
Figure 13:
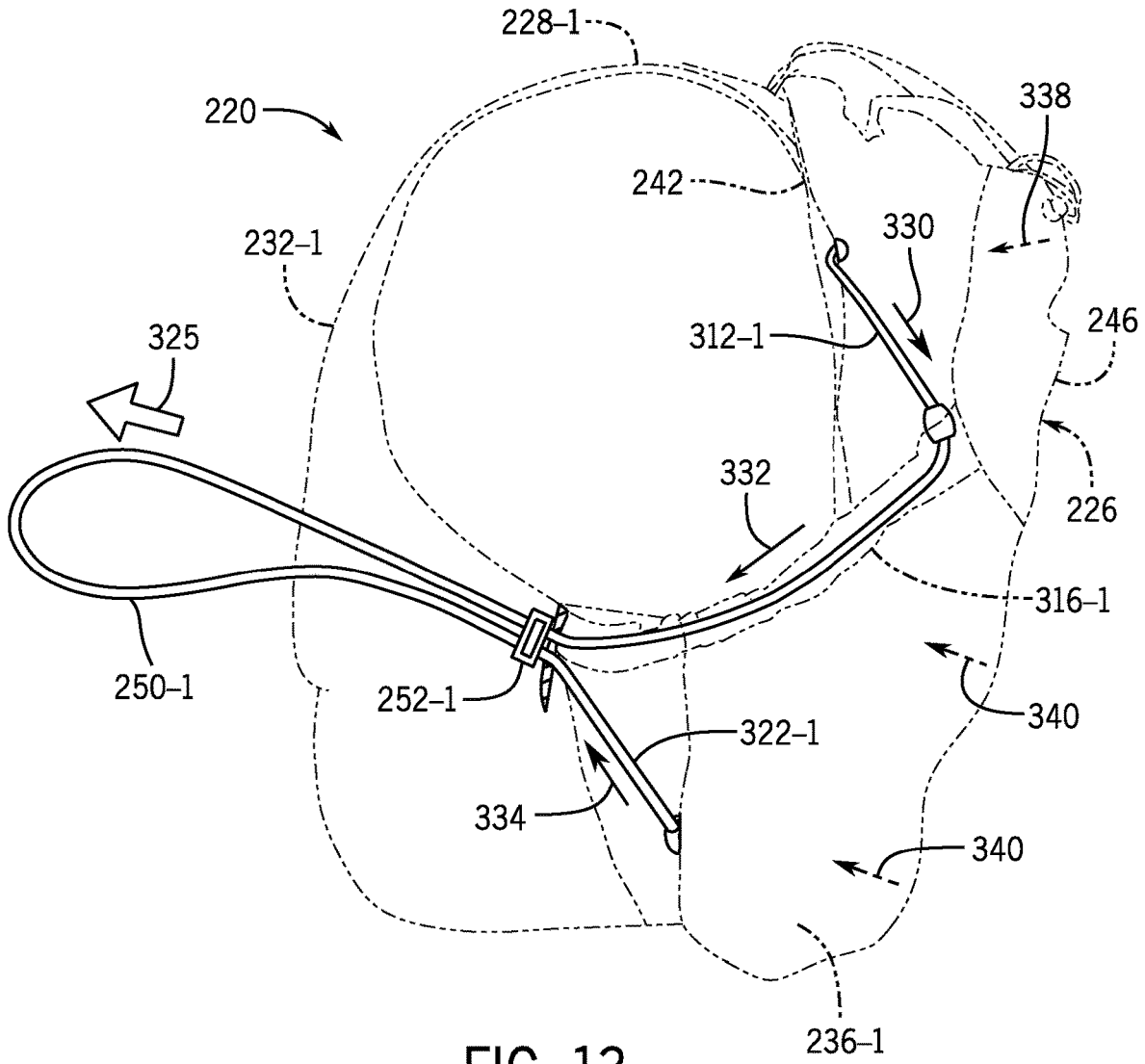
FIG. 13 is a left side view of the pack of FIG. 1 during load compression and cinching.

FIGS. 11-13 illustrate the concurrent load compression and cinch back to 20 by main compartment cinching system 240 while pack 20 is being worn by person 22. FIGS. 12 and 13 illustrate the left cinch cord 250-1 being pulled or drawn by person 22 grasping pulled portion 320-1 and pulling in the direction indicated by arrow 325. It should be appreciated that the right side cinch cord 250-2 may likewise be pulled forwardly in a similar fashion. As further shown by FIGS. 12 and 13, such pulling results in the movement of cinch cord 250-1 in the directions indicated by arrows 330, 332 and 334. In particular, intermediate portion 312-1 passes further through sleeve 316-1 as indicated by arrows 330 and 332 and through cinch cord retainer 252-1. This results in the upper portion of the rear side 246 of main compartment 226 being compressed as indicated by arrow 338. Such pulling of cinch cord 250-1 further results in intermediate portion 322-1 moving in the direction indicated by arrow 334 and being further pulled through or drawn through cinch cord retainer 252-1. This results in the lower portion of rear side 246 of main compartment 226 being compressed forwardly towards the front side 242 of main compartment 226 as indicated by arrows 340. As a result, the contents or load of main compartment 226 is compressed such that it may be less likely for such articles to move within the interior of compartment 226 during a runner hike.

Such pulling of cinch cord 250-1 further cinches pack 220 against the back of person 22 and about the side. Pulling of cinch cord 250-1 (and cinch cord 250-2) draws compression panel 236-1 (and compression panel 236-2) about side of person 22. Pulling of cinch cord 250-1 and 250-2 further results in the deformable or flexible panel or panels forming front side 242 of main compartment 226 to bend in the form into a shape or closely conforming to the shape of the back of person 22, such cinching results in a tighter fit of pack 220 relative to person 22, conforming to the particular anatomy of person 22. As a result, back to 20 may better move in unison with the movement of person 22 as he or she is running or hiking.

Such pulling of cinch cords 250-1, 250-2 further draw compression panels 236-1 and 236-2 inwardly to compress and more tightly engage any articles within pocket 262-1 and 262-2, respectively. As shown by FIG. 14, articles, such as walking sticks 347, may be stored within either of pockets 262. In the example illustrated, the exposed intermediate portion 312-2 of cinch cord 250-2 extends over such articles, retaining such articles 347 against the side 42 of main compartment 226. Pulling of cinch cord 250-2 results in articles 347 being more securely retained within pocket 262. Release of cinch cord 250-2 facilitates withdrawal of articles 347 from pocket 262-2.

Due to the particular example routing of cinch cords 250, more effective load compression and cinching is achieved. Because cinch cords 250 extend across the entire the entire thickness of main compartment 226, substantially the entire uncompressed thickness of main compartment 226 is compressible. Because end portions 310 and 324 are vertically spaced by a vertical distance equal to or greater than a majority of the vertical height of main compartment 26, along the front side 242 of main compartment 226, a majority of the vertical height of main compartment 226 is compressible. The effectiveness of such compression is further enhanced due to cinch cords 250 traversing across the uncompressed thickness of main compartment 226 multiple times. Intermediate portions 312 extend across the uncompressed thickness a first time while intermediate portions 318 extend across the uncompressed thickness a second time. Because intermediate portions 318 are substantially equidistantly vertically spaced between and portions 310 and 324, the compression of those portions of main compartment 226 between such end portions 310 and 324 is more uniform.

After person 22 has attained a desired degree of load compression and pack cinching, cinch cord retainers 252 may be actuated to grip the respective cinch cords 250 and maintain the current length of such cinch cords 250 extending between cinch cord retainers 252 and the rear side 246 of main compartment 226. As a result, the current load compression and degree of cinching is maintained. At such point in time, pulling portions 320 may be deposited and concealed within their respective pockets 290. Following a run or hike or when the person 22 otherwise desires to loosen load compression or the cinching such as when articles are to be removed from pack 220, person to 22 may manipulate cinch cord retainers 252 and lessen the tension of cinch cords 250, increasing the effective cinch cord retainer 252 and the rear side 246 of main compartment 226 as a result, the degree of compression of main compartment 226 and the extent to which pockets 262 are closed or constricted may be less there from. The degree of cinching of pack 220 with respect to person 22 may be lessened to facilitate a more comfortable fit or to facilitate the removal of pack 220.

Although the present disclosure has been described with reference to example implementations, workers skilled in the art will recognize that changes may be made in form and detail without departing from the scope of the claimed subject matter. For example, although different example implementations may have been described as including features providing benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements. The terms "first", "second", "third" and so on in the claims merely distinguish different elements and, unless otherwise stated, are not to be specifically associated with a particular order or particular numbering of elements in the disclosure.

What is claimed is:

1. A pack comprising:

a main compartment to extend along a back of a person wearing the pack, the main compartment having a front side to extend proximate the back of the person and a rear side to extend distant the back of the person;

left and right shoulder supports coupled to the main compartment to extend over the shoulders of the person;

left and right chest panels extending from the left and right shoulder supports, respectively;

left and right compression panels coupled to the left and right chest panels, respectively, and extending to along the left and right sides of the person, respectively, to the rear side of the main compartment; and a main compartment cinching system having left and right cinch cords and left and right cinch cord retainers located along left and right sides, respectively, wherein the left and right cinch cords each extend across a respective side of the main compartment a plurality of times, such that when the pack is worn, the left and right cinch cords being pullable to concurrently compress the main compartment and cinch the left and right compression panels about a torso of the person.

2. The pack of claim 1, wherein the left and right chest panels are joined end-to-end to the left and right compression panels, respectively.

3. The pack of claim 1, wherein the left and right chest panels are joined to the rear face of the main compartment.

4. The pack of claim 1, wherein the left and right compression panels form left and right pockets between the left and right compression panels, respectively, and the main compartment and wherein the left and right cinch cords are to cinch the left and right pockets towards a closed state.

5. The pack of claim 4 further comprising left and right pockets to removably receive and conceal the pull portions of the left and right cinch cords.

6. The pack of claim 4, wherein portions of the left and right cinch cords extend from the rear side to the front side of the main compartment while overlying the left and right pockets, respectively.

7. The pack of claim 4, wherein the left and right compression panels are configured to extend along left and right sides of the person wearing the pack.

8. The pack of claim 1 further comprising left and right cord locks secured to the pack to retain the left right cinch in a cinched state.

9. A pack comprising:

a main compartment to extend along a back of a person wearing the pack, the main compartment having a front side to extend proximate the back of the person and a rear side to extend distant the back of the person;

left and right shoulder supports coupled to the main compartment to extend over the shoulders of the person;

left and right chest panels extending from the left and right shoulder supports to left and right sides of the main compartment, respectively; and a main compartment cinching system to draw and compress the rear side of the main compartment towards the back of the person, the main compartment cinching system comprising:

a left cord lock secured proximate the left chest panel;

a left cinch cord connected to the main compartment at a first location proximate the rear side of the main compartment and extending through the left cord lock and along the left chest panel;

a right cord lock secured proximate the right chest panel; and a right cinch cord connected to the main compartment at a second location proximate the rear side of the main compartment and extending through a right cord lock and along the right chest panel; wherein the left cinch cord is connected to the main compartment at a third location proximate the front side above the first location and wherein the right cinch cord is connected to the main compartment at a fourth location proximate the front side above the second location.

10. The pack of claim 9, wherein the left and right chest panels are releasably connected to one another by a sternum connector.

11. The pack of claim 9, wherein the left cinch cord is connected to the left compression panel at a fifth location proximate the front side below the first location and wherein the right cinch cord is connected to the right compression panel at a sixth location proximate the front side below the second location.

12. The pack of claim 9, further comprising left and right compression panels secured to the rear side of the main compartment and extending along the left and right chest panels, respectively, wherein the left and right cinch cords are slidably coupled to the left and right compression panels to cinch the left and right compression panels, respectively, towards a front of the person wearing the pack.

13. The pack of claim 12, wherein the left and right compression panels form left and right pockets between the left and right compression panels, respectively, and the main compartment and wherein the left and right cinch cords are to cinch the left and right pockets towards a closed state.

14. The pack of claim 12, wherein the rear side is spaced from the front side by an uncompressed compartment thickness and wherein the left cinch cord and the right cinch cord each extend along at least 75% of the uncompressed compartment thickness.

15. The pack of claim 9, wherein the left cinch cord is slidable through a left sleeve connected to the left compression panel and wherein the right cinch cord is slidable through a right sleeve connected to the right compression panel.

16. The pack of claim 15, wherein the left sleeve extends along the left compression panel to forward the front side of the main compartment and wherein the right sleeve extends along the right compression panel to forward the front side of the main compartment.

17. The pack of claim 15, wherein the left compression panel extends from and is directly connected to the rear side of the main compartment and wherein the right compression panel extends from and is directly connected to the rear side main compartment.

18. The pack of claim 17 further comprising a left forward pocket forward the left compression panel for receiving left cinch cord and a right forward pocket forward the right compression panel for receiving the right cinch cord.

19. The pack of claim 17, wherein the left cord lock is vertically between the first location and the fifth location and wherein the right cord lock is vertically between the second location and the sixth location.

20. A pack comprising: a main compartment to extend along a back of a person wearing the pack, the main compartment having a front side to extend proximate the back of the person and a rear side to extend distant the back of the person; left and right shoulder supports coupled to the main compartment to extend over the shoulders of the person; left and right chest panels extending from the left and right shoulder supports to left and right sides of the main compartment, respectively; and a main compartment cinching system to draw and compress the rear side of the main compartment towards the back of the person, the main compartment cinching system comprising: a left cord lock secured proximate the left chest panel; a left cinch cord connected to the main compartment at a first location proximate the rear side of the main compartment and extending through the left cord lock and along the left chest panel; a right cord lock secured proximate the right chest panel; and a right cinch cord connected to the main compartment at a second location proximate the rear side of the main compartment and extending through a right cord lock and along the right chest panel; wherein the left cinch cord has a first end connected to a front side of the main compartment, extends from the front side of the main compartment to a rear side of the main compartment, slidably extends through a sleeve from the rear side of the main compartment along the left compression panel, passes through the left cord lock, reenters and passes through the left cord lock to a second end connected to the left compression panel at a location proximate the front side of the main compartment.

* * * * *